US008904697B2

(12) United States Patent
Park

(10) Patent No.: US 8,904,697 B2
(45) Date of Patent: Dec. 9, 2014

(54) DEVICES AND METHODS FOR SHIELDING A GUN-MOUNTED SCOPE TO PREVENT BUMPING AND MISALIGNMENT OF THE SCOPE

(71) Applicant: Immovable Optics, LLC, Ladue, MO (US)

(72) Inventor: Clayton M. Park, Ladue, MO (US)

(73) Assignee: Immovable Optics, LLC, Ladue, MO (US)

( * ) Notice: Subject to any disclaimer, the term of this patent is extended or adjusted under 35 U.S.C. 154(b) by 0 days.

(21) Appl. No.: 13/953,518

(22) Filed: Jul. 29, 2013

(65) Prior Publication Data

US 2014/0026463 A1 Jan. 30, 2014

Related U.S. Application Data

(60) Provisional application No. 61/676,533, filed on Jul. 27, 2012.

(51) Int. Cl.
*F41G 11/00* (2006.01)
*F41G 1/38* (2006.01)

(52) U.S. Cl.
CPC ..... *F41G 1/383* (2013.01)
USPC ..... 42/143; 42/129; 42/90

(58) Field of Classification Search
CPC ..... F41A 35/02; F41A 35/00; F41G 1/383; F41G 1/08; F41G 11/003; F41G 1/42; F41G 1/545; F41G 1/387; F41G 1/04; F41C 27/00; F41C 33/0254
USPC ..... 42/85, 90, 111, 124, 125, 129, 143, 106
See application file for complete search history.

(56) References Cited

U.S. PATENT DOCUMENTS

| | | | | | |
|---|---|---|---|---|---|
| 2,534,061 | A | * | 12/1950 | Rogers | 42/129 |
| 2,599,689 | A | | 6/1952 | Brelsford | |
| 2,632,252 | A | * | 3/1953 | Blais, Sr. | 359/511 |
| 3,208,146 | A | | 9/1965 | Nelson | |
| 3,977,113 | A | | 8/1976 | Howell | |
| 5,003,697 | A | * | 4/1991 | Hampton | 42/129 |
| 5,183,953 | A | * | 2/1993 | Anderson et al. | 42/96 |
| 5,388,005 | A | * | 2/1995 | Wilson | 359/694 |
| 5,566,490 | A | * | 10/1996 | Owen | 42/90 |
| 5,661,920 | A | * | 9/1997 | Evans | 42/96 |
| 5,850,706 | A | * | 12/1998 | Evans | 42/96 |
| D423,629 | S | * | 4/2000 | Granger | D22/108 |
| D445,475 | S | * | 7/2001 | Spear | D22/108 |
| 7,213,360 | B1 | * | 5/2007 | Galloway et al. | 42/96 |
| 7,484,856 | B1 | * | 2/2009 | Newhall et al. | 359/511 |
| D609,767 | S | * | 2/2010 | Brewer | D22/108 |
| 7,836,625 | B2 | * | 11/2010 | Swan et al. | 42/127 |
| 8,181,379 | B2 | * | 5/2012 | Brewer | 42/129 |
| 8,240,076 | B2 | * | 8/2012 | Carley | 42/129 |
| D673,239 | S | * | 12/2012 | Cheng | D22/109 |
| 8,505,228 | B2 | * | 8/2013 | Cheng | 42/90 |
| 2003/0074822 | A1 | * | 4/2003 | Faifer | 42/71.01 |
| 2010/0037506 | A1 | * | 2/2010 | Carley | 42/129 |
| 2010/0251594 | A1 | * | 10/2010 | Brewer | 42/143 |

* cited by examiner

*Primary Examiner* — Benjamin P Lee
(74) *Attorney, Agent, or Firm* — Harness, Dickey & Pierce, P.L.C.

(57) ABSTRACT

Exemplary embodiments are disclosed of scope shields, protectors, guards or devices for shielding and/or guarding gun-mounted scopes. Also disclosed are methods for shielding and/or guarding a gun-mounted scope. In use, exemplary embodiments disclosed herein, for example, may prevent bumping of the scope by another object and the misalignment that might otherwise occur if the scope was bumped by another object.

19 Claims, 12 Drawing Sheets

DEVICES AND METHODS FOR SHIELDING A GUN-MOUNTED SCOPE TO PREVENT BUMPING AND MISALIGNMENT OF THE SCOPE

CROSS-REFERENCE TO RELATED APPLICATION

This application claims the benefit and priority of U.S. Provisional Application No. 61/676,533 filed Jul. 27, 2012. The entire disclosure of the above application is incorporated herein by reference.

FIELD

The present disclosure relates to devices and methods for shielding and/or guarding a gun-mounted scope, for example, to prevent bumping of the scope by another object and the misalignment that might otherwise occur if the scope was bumped by another object.

BACKGROUND

This section provides background information related to the present disclosure which is not necessarily prior art.

Scopes and telescopic sights are commonly used on guns to allow the shooter to see farther. They may be used on a wide variety of guns, including hunting rifles (e.g., .30-06 rifle, .30-30 rifle, etc.), assault rifles (e.g., AR-15, etc.), military sniper rifles (e.g., M40 or M24 United States Marine Corps sniper rifle, etc.), rifles used by law enforcement or police, etc.

Before using a scope, it must first be sighted in at a targeting range, etc. to make sure that the aim is accurate. And after the scope is sighted in, care must be taken to prevent the scope from being bumped, jarred, or otherwise struck to avoid knocking the scope out of proper alignment. For example, it is not uncommon for a deer hunter to accidently bump a rifle scope against a tree while climbing to a tree stand, which, in turn, may cause misalignment of the scope.

SUMMARY

This section provides a general summary of the disclosure, and is not a comprehensive disclosure of its full scope or all of its features.

Exemplary embodiments are disclosed of scope shields, protectors, guards or devices for shielding and/or guarding gun-mounted scopes. Also disclosed are methods for shielding and/or guarding a gun-mounted scope. In use, exemplary embodiments disclosed herein, for example, may prevent bumping of the scope by another object and the misalignment that might otherwise occur if the scope was bumped by another object.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 6:
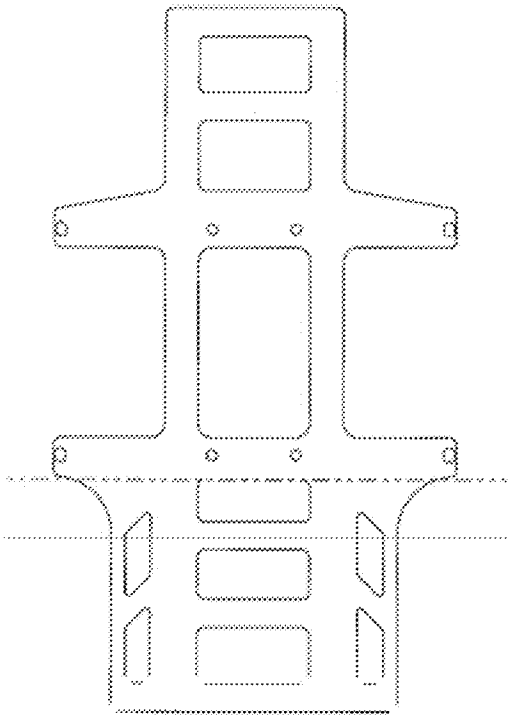
Figure 5:
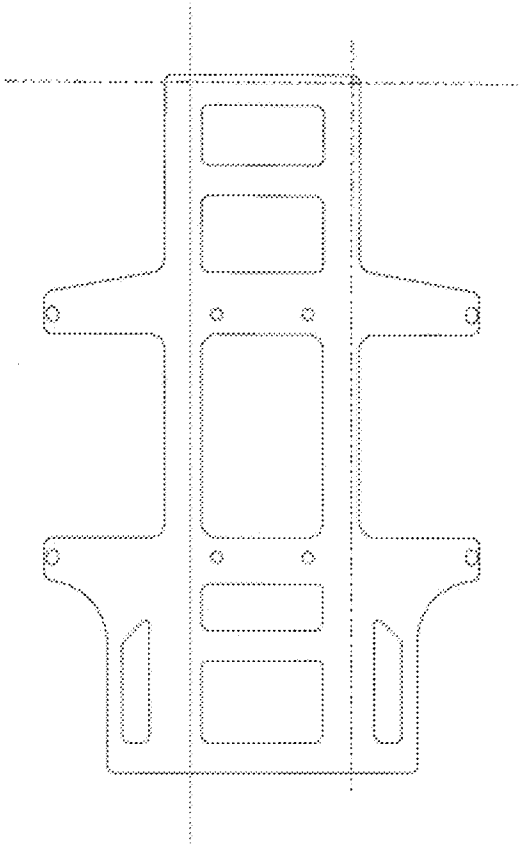
Figure 4:
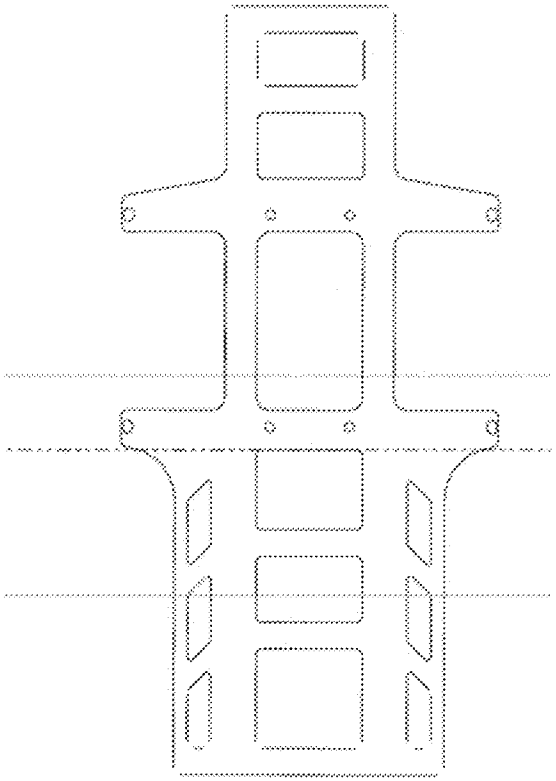
Figure 7:
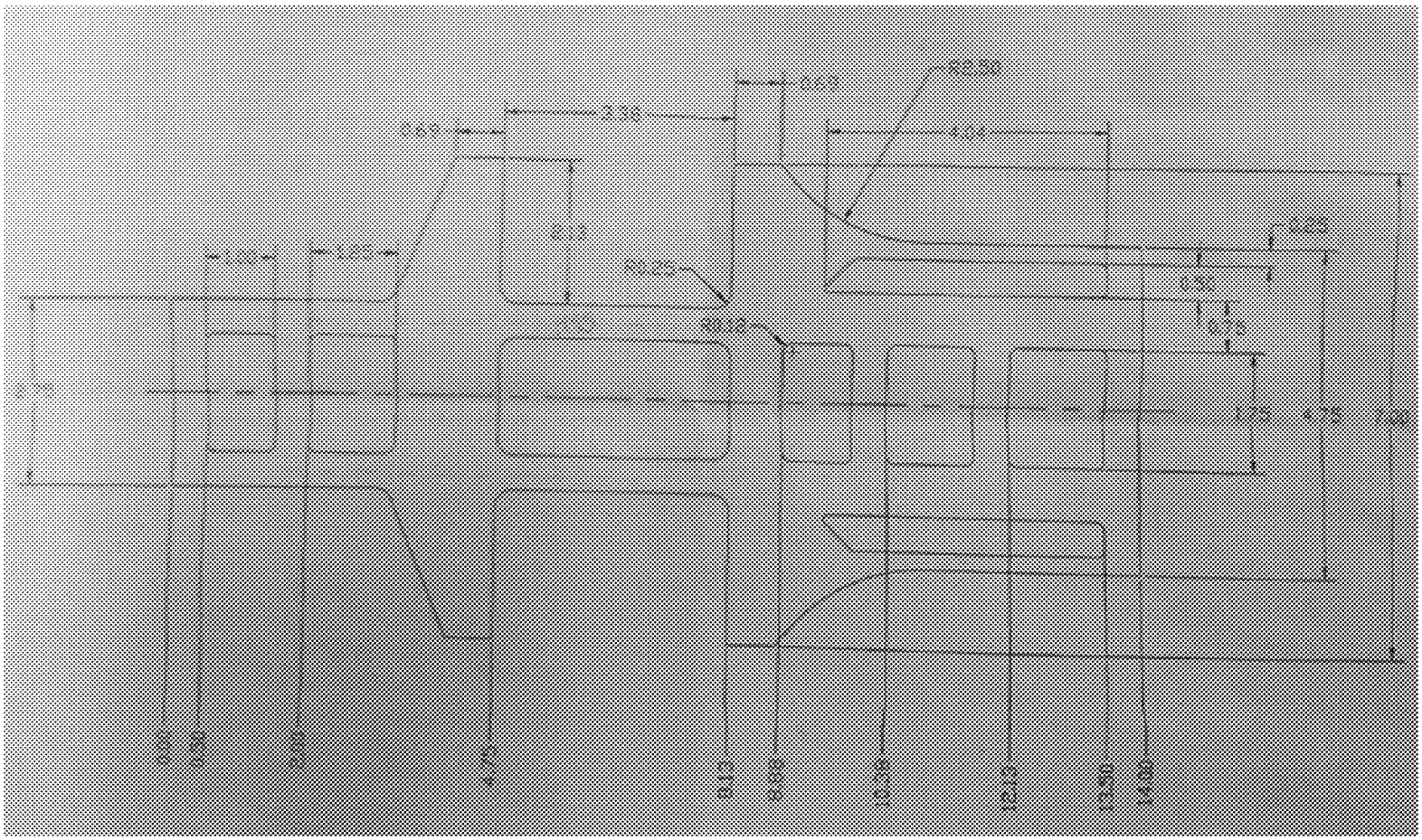
Figure 8:
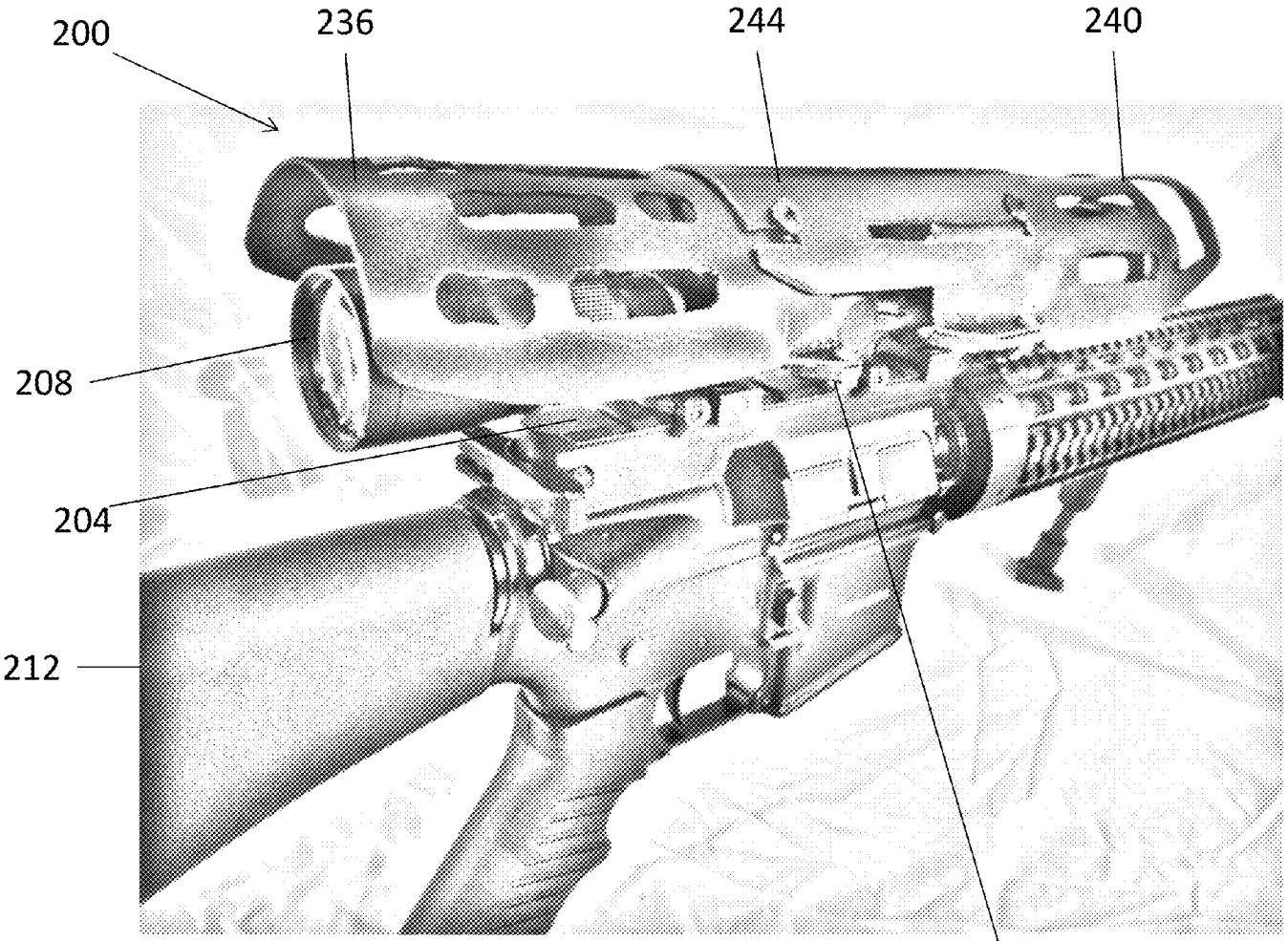
Figure 9:
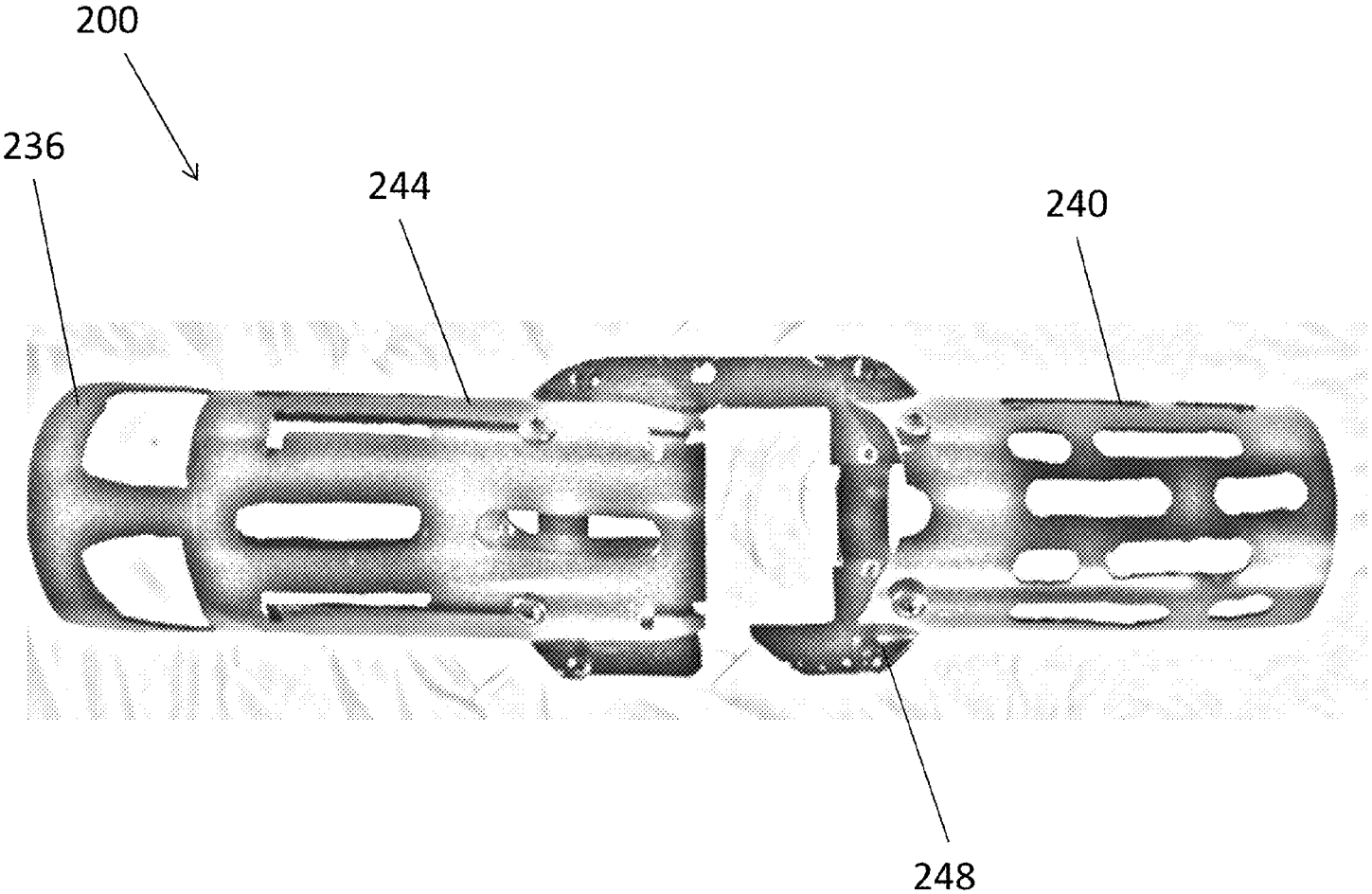
Figure 10:
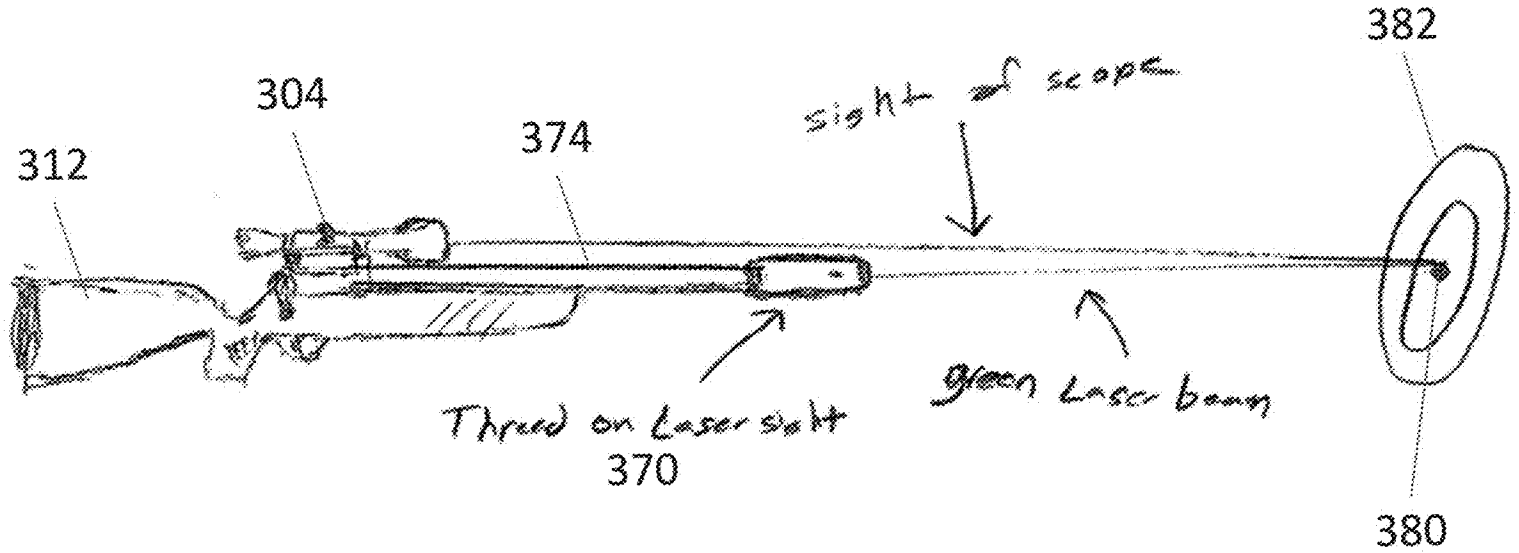
Figure 11:
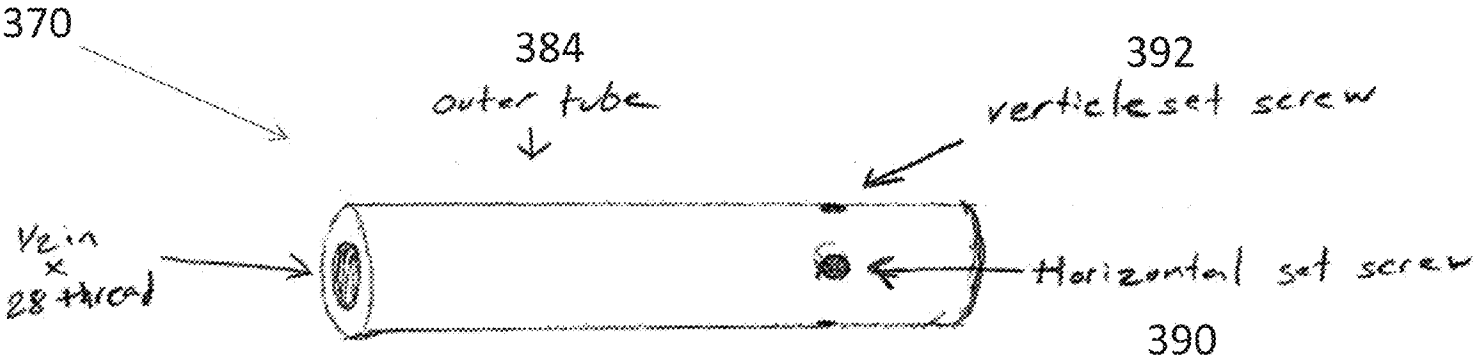
Figure 12:
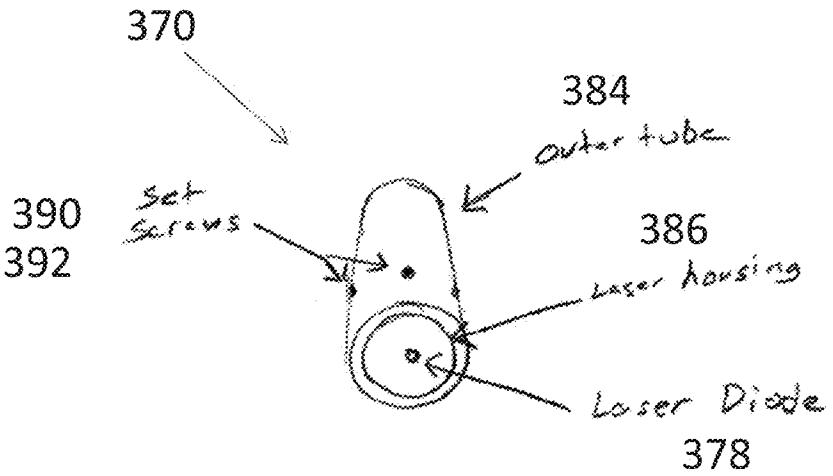

FIGS. 4, 5, and 6 illustrate stamped flat metal pieces that may be formed (e.g., bent, shaped, etc.) into a device as shown in FIGS. 2A-D which device may then be mounted to the rails over the scope for shielding and/or guarding the scope according to exemplary embodiments;

FIG. 7 illustrates a stamped flat metal piece that may be formed (e.g., bent, shaped, etc.) into a device as shown in FIGS. 2A-D which device may then be mounted to the rails over the scope and also showing exemplary dimensions in inches for purpose of illustration only according to an exemplary embodiment;

FIG. 8 shows an AR-15 semi-automatic rifle having a scope mounted to its rails and also showing an exemplary embodiment of a device also mounted to the rails over the scope, where the device includes a slidable middle portion to allow a user to access to the scope's wind and elevation knobs according to an exemplary embodiment;

FIG. 9 shows the device of FIG. 8 where the middle portion of the device is shown slidably moved forward to an open configuration in which a user may access the scope's wind and elevation knobs, and also showing an exemplary mounting bracket that may be mechanically fastened (e.g., bolted, etc.) to the rails of the gun, where the mounting bracket includes holes for mechanically fastening the body of the device to the mounting bracket according to an exemplary embodiment;

FIG. 10 illustrates an exemplary embodiment of a laser sighting threaded onto the end of a barrel of a gun;

FIG. 11 is a perspective side view of the laser sighting shown in FIG. 10; and FIG. 12 is a perspective end view of the laser sighting shown in FIGS. 11 and 12.

DETAILED DESCRIPTION

Example embodiments will now be described more fully with reference to the accompanying drawings.

Exemplary embodiments are disclosed of scope shields, protectors, guards or devices for shielding and/or guarding gun-mounted scopes. Also disclosed are methods for shielding and/or guarding a gun-mounted scope. In use, exemplary embodiments disclosed herein, for example, may prevent bumping of the scope by another object and the misalignment that might otherwise occur if the scope was bumped by another object.

In an exemplary embodiment, the device or scope guard is generally an exoskeleton protective shield that mounts to an existing rail system (e.g., picatinny (pic) rail system, etc.) to generally surround a scope and extend past both ends of the scope without touching the scope or the scope's mounts or mounting brackets. Advantageously, the device is configured to protect the scope from being knocked out of alignment while transporting it or while using it in the field. For assault rifles, the device or scope guard may be mounted to the long pic rail system that comes on the gun to mount the scope. For bolt action rifles, a pic rail system may be added to the gun to provide a sufficiently long enough rail to mount both the scope and the scope guard/device. By attaching the scope guard to a pic rail system, a bump that would usually hit the scope and knock it out of alignment will instead be absorbed by the scope guard/device and be transferred to the frame of the gun to thereby increase dependable accuracy while using a scope.

Exemplary embodiments of the device or scope guard are mountable to a gun and include features to allow adjustments (e.g., focusing, magnification, windage, elevation) to be made without having to remove the device or scope guard. For example, exemplary embodiments are disclosed that include relatively large holes cut or stamped at the front and back of the scope guard to allow a user to reach through the holes and adjust the focus and magnification without having to move anything or any part of the scope guard.

Some exemplary embodiments may include a middle portion of the scope guard that is slidably movable, e.g., in a forward direction, to expose the windage and elevation knobs of the scope for adjustment in the field. When the middle portion of the scope guard is slid back to its original or closed position, the middle portion may be locked into place by a locking mechanism, such as a spring locking pin, a twist lock on an L-shaped rail it slides on, etc. In such exemplary embodiments, the ability of the middle portion to be slidably moved allows quick adjustments to be made for windage and elevation in the field quietly and quickly without making the gun more bulky. The middle portion can then be slid back to maximize the area of protective coverage of the scope.

In exemplary embodiments, the device or scope guard extends out past both ends of the scope and past the sides. But the device may be cut up high enough for bullet casings or shells to eject from the gun and allow enough space to open a bolt action rifle and pull it back. The device may be sufficiently long and wide to substantially enclose the entire scope or telescopic sight of the gun while being held in spaced-apart relation from the scope.

In alternative embodiments, there is another option for allowing a user to access and reach the windage and elevation adjustment features (e.g., knobs). This alternative option is to have the whole device or scope guard slide forward as a single piece on rails connected to the pic rail system with multiple holes to lock into, so the device or scope guard can be moved as far or as little as needed. Sliding the whole device or scope guard forward would allow for more access to the back of the scope while shielding the front from the sun to prevent glare.

The particular configuration of the device or scope guard will depend on what gun the scope guard will be mounted on and whether there are other accessories in front of the scope. For example, the gun and its accessories will determine whether a partial sliding middle access point or a full sliding scope guard would better fit for the purpose of the shooter. In some embodiments, the scope guard does not include any sliding portions but instead has openings to allow access to the scope adjustment features.

A wide range of materials may be used for the device or scope guard. By way of example, the device or scope guard may be made out of 16 gauge steel. In other exemplary embodiments, the device or scope guard may be made of aluminum for its light weight and high strength. Other suitable materials may also be used, such as other types of steel, titanium, carbon fiber, high strength plastics, etc. The selection of materials depends on, for example, manufacturing costs versus benefit. A device or scope guard may be made quickly and at a cost efficient price in large amounts by stamping the shape and openings therein while flat (e.g., FIGS. 4 through 7, etc.) and then bending and rolling it into a desired final shape, e.g., a semi-cylindrical or upside down U shape, etc. A device or scope guard may also be made using CNC (computer numerical control) mills, but this will also depend on manufacturing costs versus benefit and the total number of scope guards being manufactured at a time.

Figure 3:
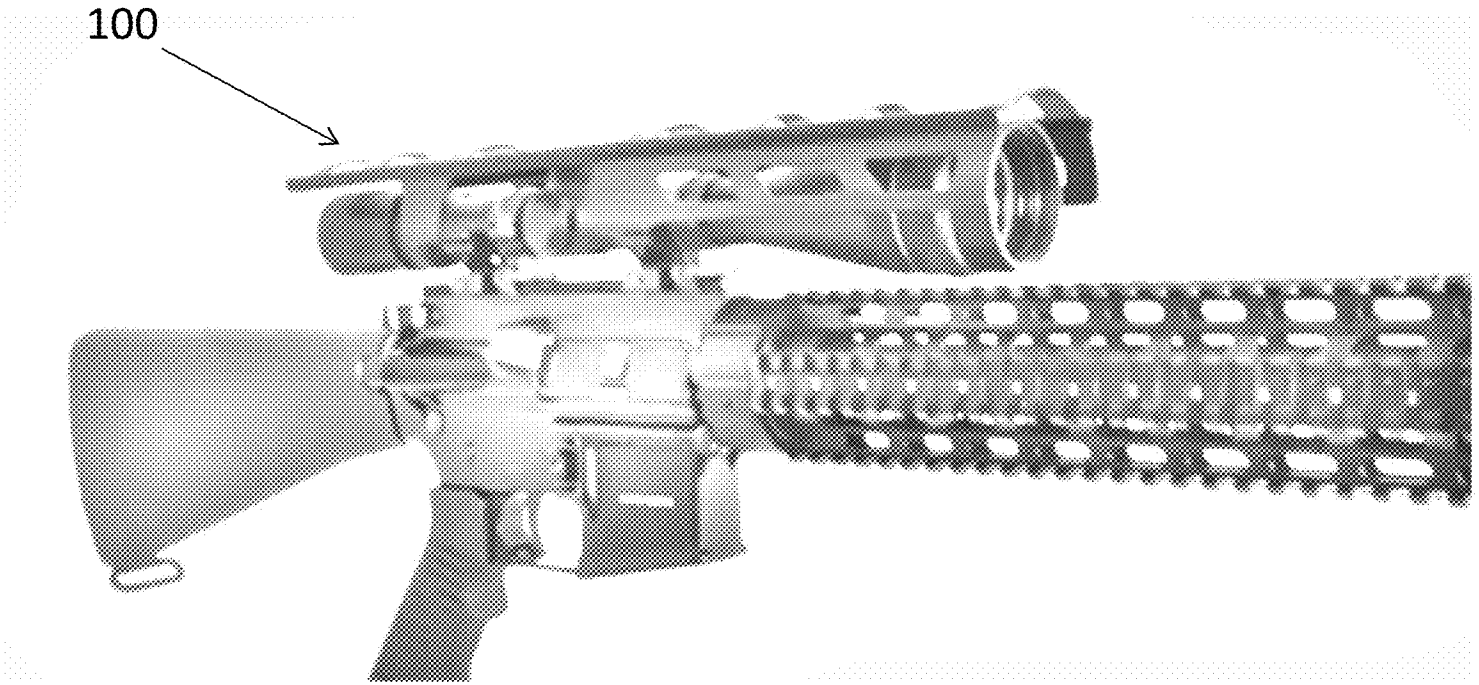
FIG. 3 shows an AR-15 semi-automatic rifle having a scope mounted to its rails, and also showing an exemplary embodiment of a device mounted to the rails over the scope.

In exemplary embodiments, the device or scope guard (e.g., FIGS. 1-3, etc.) mounts directly to an existing rail system (e.g., picatinny (pic) rail system, etc.) to generally surround a scope and extend past both ends of the scope without touching the scope or the scope's mounts or mounting brackets. In other embodiments, a device or scope guard may be mountable via a frame element or bracket (e.g., FIGS. 8 and 9, etc.) that is mechanically fastened to the body of the device and the rails of the gun. The body may be approximately semi-circular or upside down U-shape in cross section and open at its bottom while in its normal use position. The opposite ends of the scope guard are open and unobstructed to allow normal usage of the gun scope when the device is mounted on the rails of the gun. The device or scope guard, while sturdy, does not add greatly to the weight of the gun. It protects the scope from direct physical contact with objects likely to damage the scope or knock it out of alignment.

In some exemplary embodiments, the device or scope guard includes means for allowing one or more accessories to be mounted to the device. For example, exemplary embodiments may include threaded holes in the top or side portions of a body of the device to allow one or more accessories (e.g., threaded gun sights, etc.) to be added to the device.

Figure 1:
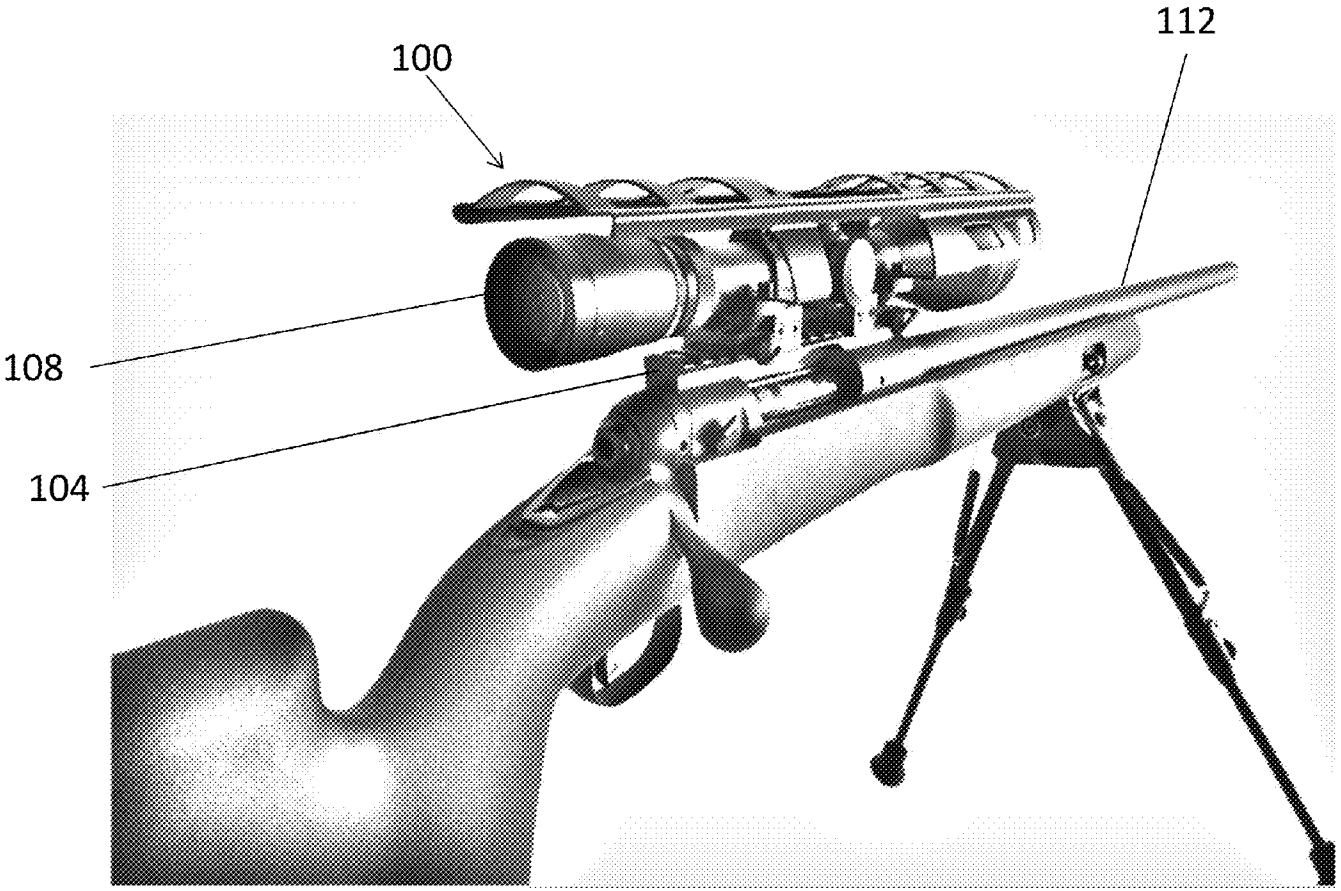
FIG. 1 shows a bolt action rifle having a scope mounted to its rails and also shows an exemplary embodiment of a device mounted to the rails over the scope.
Figure 2A:
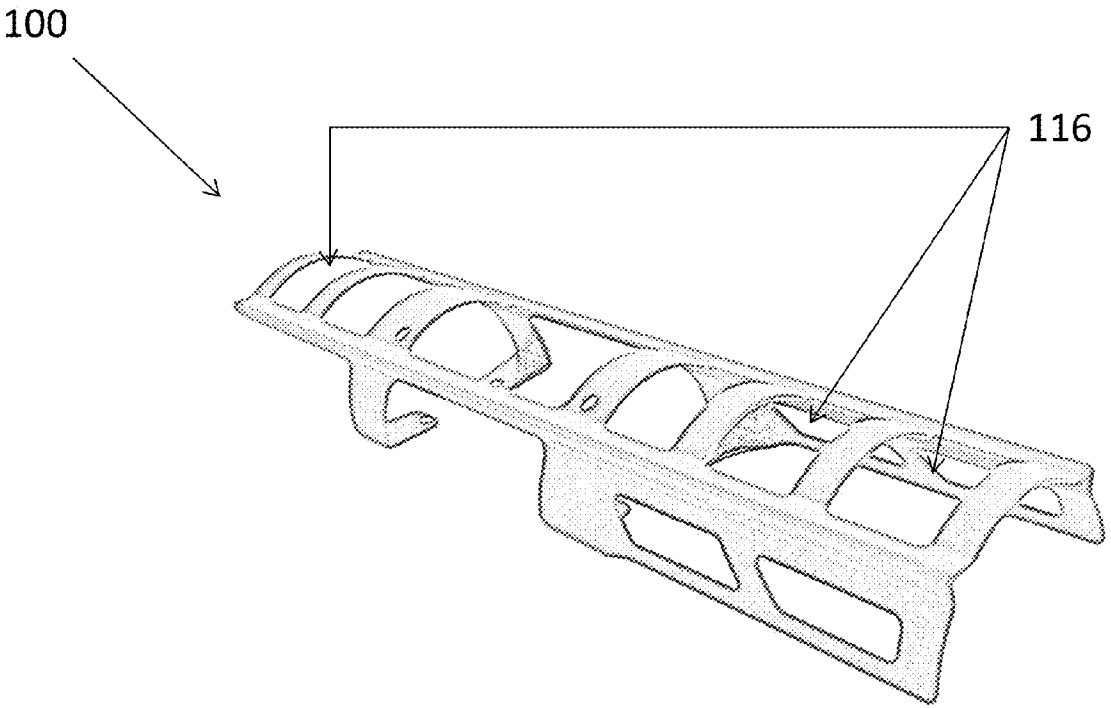
FIG. 2A shows the device of FIG. 1 and also shows the device's openings for allowing a user access scope adjustment features such as focus adjustment rings.
Figure 2B:
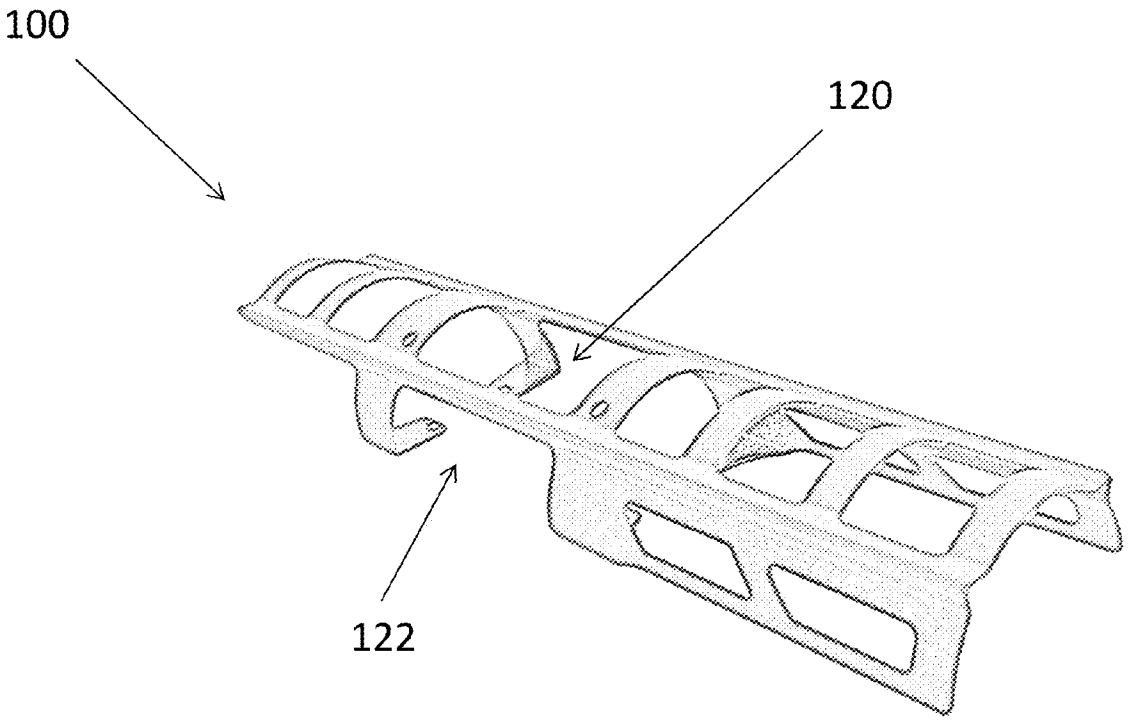
FIG. 2B shows the device of FIG. 1 and also shows the device's bash openings for allowing a user access scope adjustment features such as elevation and windage agjustment knobs.
Figure 2C:
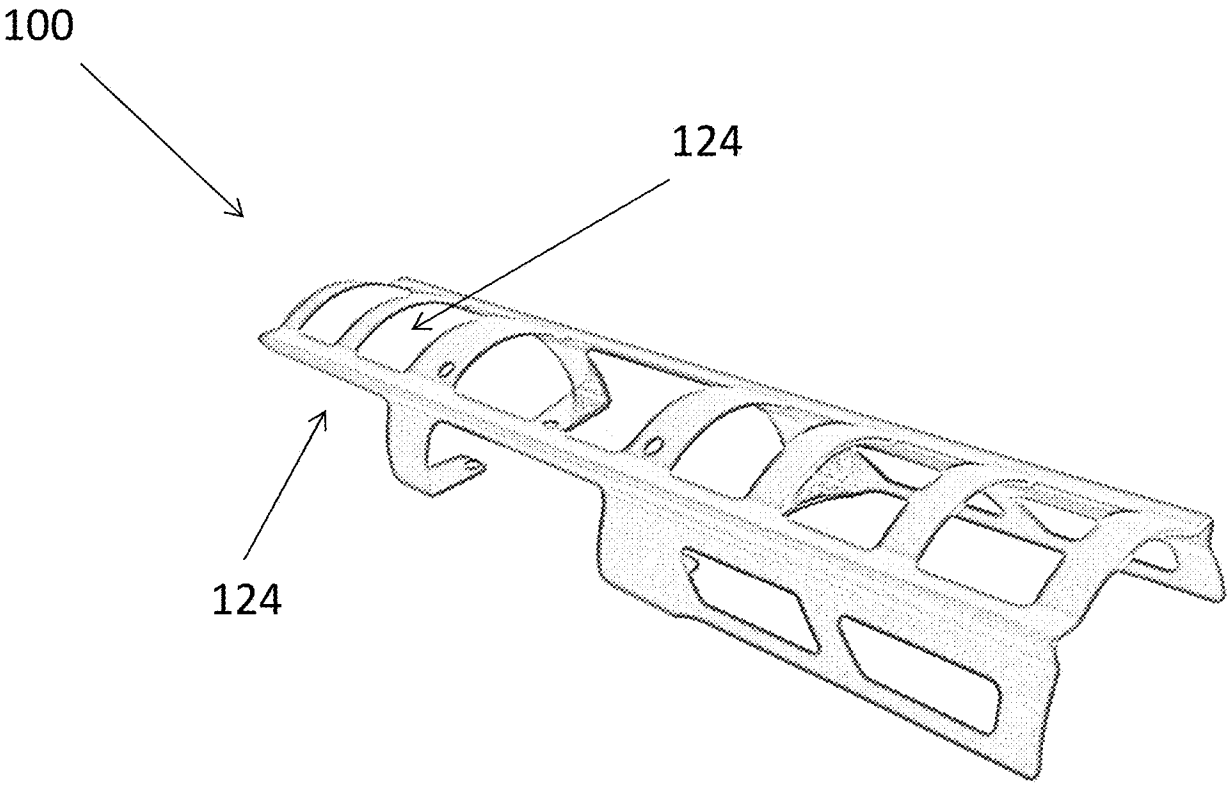
FIG. 2C shows the device of FIG. 1 and also shows the device's openings for allowing a user to access scope adjustment features such as a magnification adjustment ring of the scope.
Figure 2D:
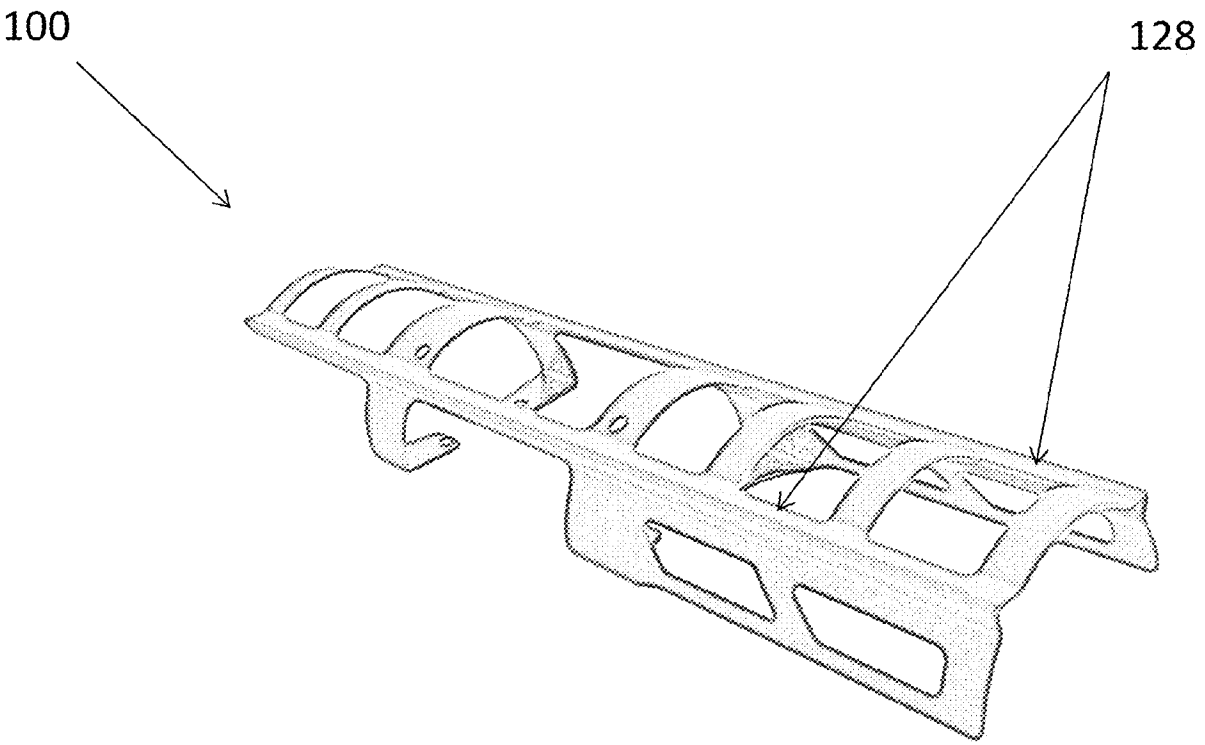
FIG. 2D shows the device of FIG. 1 and also shows the device's bash guard rails.

With reference now to the figures, FIG. 1 illustrates an exemplary embodiment of a device or scope guard 100 embodying one or more aspects of the present disclosure. As shown in FIG. 1, the device 100 mounts to an existing rail system 104 (e.g., picatinny (pic) rail system, etc.) to generally surround a scope 108 also mounted to the rails 104 of the gun 112. FIG. 1 shows the device 100 mounted to the rails 104 a bolt action rifle 112. Alternatively, the device 100 may be mounted to other types of guns, including the AR-15 semi-automatic rifle shown in FIG. 3.

With continued reference to FIG. 1, the device 100 extends past both ends of the scope 108 without touching the scope 108. Advantageously, the device 100 is configured to protect the scope 108 from being knocked out of alignment while transporting it or while using it in the field. By attaching the scope guard 100 to the pic rail system 104, a bump that would usually hit the scope 108 and knock it out of alignment will instead be absorbed by the scope guard or device 100 and be transferred to the frame of the gun 112.

The device 100 includes openings or cutouts to allow normal usage of the scope 108 while the device 100 is on the gun 112. As shown in FIGS. 2, the device 100 includes openings for allowing access to the scope's features, such as one or more of the scope's rings or knobs for magnification, focusing, elevation, windage, etc. More specifically, the device 100 includes openings 116 for focus adjustment, openings 120 and 122, respectively for elevation and windage adjustment, and openings 124 for magnification adjustment.

The device also includes rails or ridges 128. The rails 128 are configured to provide increased strength and rigidity such that the device 100 can absorb impacts from different angles.

FIGS. 8 and 9 illustrate another exemplary embodiment of a device or scope guard 200 embodying one or more aspects of the present disclosure. As shown in FIGS. 8 and 9, the device 200 includes a forward portion 236, back portion 240, and a middle portion 244. In this example, the middle portion 244 of the device 200 is slidable relative to the forward portion 236 from a closed position (FIG. 8) to an open position (FIG. 9) in which a user may access the scope's wind and elevation knobs.

In this example, the device 200 may be mounted to an existing rail system 204 (e.g., picatinny (pic) rail system, etc.) by using a mounting bracket 248. When mounted to the rails 204 by the bracket 248, the device 200 generally surrounds the scope 208 of the gun 212 as shown in FIG. 8. The mounting bracket 248 includes holes for mechanically fastening the body of the device 200 to the mounting bracket 248.

Accordingly, exemplary embodiments of devices or scope guards are disclosed that generally are or function as a shield to protect a scope and preserve the existing sighting of the scope (e.g., perfect zero sighting). The device may have a relatively uncomplicated sleek and rigid design that allows the device to be easily mounted on almost any rifle. Cutouts are included along the bash guardrails that allow quick scope adjustments to be made in the field like focus, magnification, windage, and elevation. The universal design may fit on almost any rifle and mount just like a scope using a second set of mounts to transfer impacts to the frame of the gun. For example, the device or scope guard may be mounted to it to a pic rail. This allows for two sets of scope mounts, where one set of scope mounts may be used to hold the scope while the other set of scope mounts may be used to absorb the impacts thereby keeping the scope perfectly sighted at zero.

In exemplary embodiments, the device includes elevated cutouts on the back, which allows it to be used on both bolt action and automatic rifles for left and right handed shooters. The device may be a low profile and low weight (e.g., only 0.8 pounds) without sacrificing strength (e.g., strength of 16 gauge steel, etc.), thereby making the device or scope protector an essential attachment for a rifle.

Exemplary embodiments include a solid steel frame that acts like an exoskeleton absorbing shock from dings, drops, and impacts that can knock a scope off zero. The device or scope guard may be available in various sizes (e.g., three different lengths, four different lengths, etc.) to provide protection to scopes of varying sizes, such as scopes having up to 12.5 inch length, 13.5 inch length, and 14.5 inch length while lengths mounting to a 1 inch tube scope.

In exemplary embodiments, the device or scope guard is generally an exoskeleton that fits over the scope of a gun and mounts to separate scope mounts. These separate scope mounts may be mounted lower than the height of the scope to allow for clearance to have an open spacing so that the device can absorb the shock that would usually be hit by the scope and knock it off of zero. The device absorbs and transfers the impact to the frame of the gun.

The device may be made from 16 gauge steel or other suitable material. The device may include ridges for increased strength and rigidity such that it can absorb impacts from different angles. The device may include cutouts or openings along the top and the sides to allow adjustments to the scope's magnification, focus, windage, and elevation without having to remove the device from the gun. The device or scope guard may be provided in different lengths depending on the length of the scope with which it will be used. And, the openings or cutouts of the device may be designed or customized for many different scope models.

FIGS. 10 through 12 illustrate an exemplary embodiment of a laser sighting 370 embodying one or more aspects of the present disclosure. As shown in FIG. 10, the laser sighting 370 may be added (e.g., threaded onto, etc.) the end of a barrel 374 of a gun 312 and used while sighting in a scope 304. The laser sighting 370 may include a laser diode 378 (FIG. 12). In operation, the laser diode 378 produces a green laser beam that will produce a green laser dot 380 on a target 382 (FIG. 11) indicating where a bullet will hit the target 382. Accordingly, the scope 304 may be sighted to the laser dot 380 such that the gun 312 does not have to be fired to set the scope 304. By using this exemplary laser sighting 370 instead of a bore sighting, there will be tighter tolerances and better accuracy.

By way of example, the green laser diode 378 may produce a dot having a 2 inch diameter on a target 100 yards away. In comparison, a red laser diode may produce a dot having an 8 inch diameter on a target 100 yards away. The smaller dot size produced by the green laser diode 378 enables more accurate sighting of the scope.

With reference to FIGS. 11 and 12, the laser sighting 370 may be configured with ½ inch×28 threads per inch, which thread configuration is universal on many calibers. The laser sighting 370 includes an outer tube 384 and a laser housing 386 for the laser diode 378. The laser sighting 370 also includes horizontal and vertical set screws 390 and 392 for fine adjustments to increase accuracy.

Exemplary embodiments disclosed herein may be used with a wide variety of guns, including different types of guns, different sizes or calibers, etc. For example, exemplary embodiments may be used with rifles commonly used for hunting (e.g., .30-06 rifle, .30-30 rifle, bolt action rifle, etc.), assault rifles (e.g., AR-15, etc.), military guns (e.g., sniper rifle, etc.), among to others. Similarly, exemplary embodiments disclosed herein may be used with a wide variety of scopes, including different types of scopes (e.g., daytime and/or night vision scopes, etc.), scopes having different magnifications, scopes having variable or fixed magnification, etc. Furthermore, exemplary embodiments are disclosed as being mountable to picatinny rails, but other exemplary embodiments may be configured to be mountable to other types of scope mounting rails, such as weaver rails, etc. Thus, aspects of the present disclosure should not be limited to use with any one particular gun, any one particular scope, or any one particular rail system.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms (e.g., different materials may be used, configured for use with different types of guns, etc.) and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A device for shielding and/or guarding a scope mounted to a gun, the device mounted to one or more rails of the gun via one or more separate scope mounts different than scope mounts used to mount the scope, to thereby prevent an object from impacting the scope and causing scope misalignment even while the scope is being used in the field, whereby the device is operable for absorbing and transferring an impact force from an object impacting the device to a frame of the gun via the one or more rails when the device is mounted to the one or more rails of the gun over the scope.

2. The device of claim 1, wherein the one or more separate scope mounts are operable for transferring an impact force absorbed by the device to the one or more rails thereby preventing scope misalignment from the impact force and preserving an existing sighting of the scope.

3. The device of claim 1, further comprising a body positionable over the scope such that the body is spaced apart from, without touching or without attachment to, the scope or scope mounts used to mount the scope.

4. The device of claim 3, wherein the body includes opposite ends that extend past corresponding opposite ends of the scope when the device is mounted over the scope, wherein the opposite ends of the body are open and unobstructed to allow normal usage of the scope when the device is mounted to the one or more rails of the gun over the scope.

5. The device of claim 3, wherein the body includes one or more openings for allowing user access to one or more adjustment features of the scope through the one or more openings without having to move any portion of the device.

6. The device of claim 3, wherein the body includes one or more openings aligned with one or more of an elevation adjustment knob, a windage adjustment knob, a focusing adjustment ring, and/or a magnification adjustment ring of the scope, whereby the one or more openings allow normal usage of the scope as a user may reach through the one or openings to access the one or more of the elevation adjustment knob, the windage adiustment knob, the focusing adiustment ring, and/or the magnification adjustment ring of the scope without having to move any portion of the device.

7. The device of claim 3, wherein the body includes a plurality of portions at least one of which is slidably movable relative to another portion for creating an opening to allow user access to one or more adjustment features of the scope.

8. The device of claim 1, wherein:

the device comprises an exoskeleton mountable to the one or more rails via one or more separate scope mounts different than scope mounts used to mount the scope to the one or more rails, whereby the one or more separate scope mounts are operable for transferring an impact force absorbed by the exoskeleton to the one or more rails thereby preventing scope misalignment from the impact force and preserving an existing sighting of the scope;

when the exoskeleton is mounted to the one or more rails via the one or more separate scope mounts, the exoskeleton is positioned over the scope with opposite ends of the exoskeleton extending past corresponding opposite ends of the scope;

the opposite ends of the exoskeleton are open and unobstructed to allow normal usage of the scope; and the exoskeleton includes one or more openings for allowing user access to one or more adjustment features of the scope through the one or more openings without having to move any portion of the device.

9. The device of claim 3, wherein the body includes one or more threaded holes for attachment of one or more accessories to the device.

10. A device mounted to one or more rails of a gun having a scope, the device comprising a body positionable over the scope such that the body is spaced apart from, without touching or without attachment to, the scope or scope mounts used to mount the scope, wherein the body includes one or more openings for allowing user access to one or more adjustment features of the scope through the one or more openings, and opposite ends that are open and unobstructed and that extend past corresponding opposite ends of the scope, whereby the one or more openings and the opposite ends of the body allow normal usage of the scope without having to move any portion of the device.

11. The device of claim 10, wherein:

the device is configured to prevent an object from impacting the scope and causing scope misalignment; and the device is operable for absorbing and transferring an impact force from an object impacting the device to a frame of the gun via the one or more rails when the device is mounted, separately from the scope, to the one or more rails of the gun over the scope.

12. The device of claim 10, wherein the device is mountable to the one or more rails via one or more separate scope mounts different than the scope mounts used to mount the scope, whereby the one or more separate scope mounts are operable for transferring an impact force absorbed by the device to the one or more rails thereby preventing scope misalignment from the impact force and preserving an existing sighting of the scope.

13. The device of claim 10, wherein the device is mountable to the one or more rails, separately from the scope, via one or more scope mounts different than the scope mounts used to mount the scope.

14. The device of claim 10, wherein the body comprises an exoskeleton mountable to the one or more rails via one or more separate scope mounts different than the scope mounts used to mount the scope, whereby the one or more separate scope mounts are operable for transferring an impact force absorbed by the exoskeleton to the one or more rails of the gun thereby preventing scope misalignment from the impact force and preserving an existing sighting of the scope.

15. The device of claim 10, wherein the one or more openings are aligned with one or more of an elevation adjustment knob, a windage adjustment knob, a focusing adjustment ring, and/or a magnification adjustment ring of the scope, whereby the one or more openings allow a user to reach through the one or openings to access the one or more of the elevation adjustment knob, the windage adjustment knob, the focusing adjustment ring, and/or the magnification adjustment ring of the scope without having to move any part of the device.

16. The device of claim 10, wherein the body includes one or more threaded holes for attachment of one or more accessories to the device.

17. A method for shielding and/or guarding a gun-mounted scope, the method comprising separately mounting a device to one or more rails on the gun over the scope such that the device is spaced apart from, without touching or without attachment to, the scope or scope mounts used to mount the scope, to thereby prevent an object from impacting the scope and causing scope misalignment even while the scope is being used in the field, whereby the device is operable for absorbing and transferring an impact force from an object impacting the device to a frame of the gun via the one or more rails.

18. The method of claim 17, wherein separately mounting a device to one or more rails on the gun comprises using one or more mechanical fasteners to mount the device to one or more separate scope mounts different than the scope mounts used to mount the scope.

19. The method of claim 17, wherein separately mounting a device to one or more rails on the gun comprises separately mounting the device to the one or more rails of the gun via one or more separate scope mounts different than the scope mounts used to mount the scope, whereby the one or more separate scope mounts are operable for transferring an impact force absorbed by the device to the one or more rails thereby preventing scope misalignment from the impact force and preserving an existing sighting of the scope.

* * * * *